United States Patent [19]

Flemming et al.

[11] Patent Number: 4,729,420

[45] Date of Patent: Mar. 8, 1988

[54] METHOD FOR CONCLUDING THE OPERATION OF THE CONTINUOUS CASTING OF STRIP METAL

[75] Inventors: Gunter Flemming; Manfred Kolakowski, both of Erkrath, Fed. Rep. of Germany

[73] Assignee: SMS Schloemann-Siemag Aktiengesellschaft, Dusseldorf, Fed. Rep. of Germany

[21] Appl. No.: 17,623

[22] Filed: Feb. 24, 1987

[30] Foreign Application Priority Data

Feb. 27, 1986 [DE] Fed. Rep. of Germany ..... 3606289

[51] Int. Cl.[4] ..... B22D 11/18; B22D 11/20

[52] U.S. Cl. ..... 164/453; 164/454; 164/483

[58] Field of Search ..... 164/453, 454, 483, 418, 164/154, 155, 150, 449, 413

[56] References Cited

U.S. PATENT DOCUMENTS

| | | | |
|---|---|---|---|
| 3,204,460 | 9/1965 | Milnes | 164/418 X |
| 3,237,251 | 3/1966 | Thalmann | 164/413 X |
| 4,607,681 | 8/1986 | Tinnes et al. | 164/454 X |
| 4,635,702 | 1/1987 | Kolakowski et al. | 164/418 |

FOREIGN PATENT DOCUMENTS

| | | | |
|---|---|---|---|
| 56-151147 | 11/1981 | Japan | 164/150 |

*Primary Examiner*—Kuang Y. Lin

*Attorney, Agent, or Firm*—Russell & Tucker

[57] ABSTRACT

A method for concluding the operation of the continuous casting of strip metal comprising the steps of casting said strip in a narrow slotted strip shaped continuous casting mold having a flared inlet pouring zone necking down to a distal zone in which the walls of the mold are parallel and spaced apart by substantially the desired cross-sectional shape and dimensions of the strip being cast, pouring liquid metal through a pouring tube having an orifice into said flared zone, and controlling the pouring rate thereof, continuously detecting and monitoring the instantaneous surface level of the metal bath in said mold, withdrawing the casting from the distal end of said mold, and controlling the rate of withdrawal, adjusting the pouring rate and withdrawal rate so that the level of the metal bath is at a maximum height for said mold when in normal operation, continuously sensing whether or not there is present downstream of said mold evidence of the liquid core of said cast strip, reducing the pouring and withdrawal rates for concluding the casting to a rate at which the liquid core of the cast strip is near to but downstream of the mold and at which the metal bath level remains constant, terminating said pouring while continuing said withdrawal, whereby the metal bath level descends rapidly toward the neck end of said flared zone, reducing the withdrawal rate when the metal bath level is close to the lower end of the flared zone to a rate at which the upper surface of the metal bath can congeal sufficiently for further processing downstream by the time it reaches the end of the distal zone, and thereafter withdrawing the casting.

6 Claims, 8 Drawing Figures

METHOD FOR CONCLUDING THE OPERATION OF THE CONTINUOUS CASTING OF STRIP METAL

FIELD OF THE INVENTION

This invention relates to the continuous casting of strip metal, especially strip steel. More particularly it relates to a process and apparatus for the control of the interrelationships between the pouring rate of the liquid metal and the withdrawal rate of the casting from the mold during the conclusion phase of casting strip.

BACKGROUND OF THE INVENTION

It has been conventional to pour liquid metal into parallel sided continuous casting molds for the production of steel ingots, billets and slab, while maintaining the conditions of pouring, cooling and withdrawal so that the still liquid metal core within the embryonic casting, extends down into and through the parallel walled zone at the distal end of the mold (e.g. DE PS No. 887,990).

With the conventional equipments, the conclusion of casting is done by reducing both the pouring rate and the withdrawal rate, allowing for the removal of the scum (oxide) layer from the surface of the molten or liquid metal bath (which will be referred to herein simply as the "metal bath") and permitting the melt to develop a solidified covering layer as the casting is being withdrawn from the mold. With strip steel casting, however, in which a mold is used having a flared pouring zone such a procedure does not work because any bridging or solidification within the metal in the flared zone above the neck of the mold results in resistance which prevents the end of the casting from being withdrawn through the neck. For this reason, even in cases when the liquid core of the casting may still extend down into the parallel walled distal zone of the mold, unacceptible break-out causing bridging resistances are frequently experienced during the concluding phases of the casting of strip. This condition is, of course, brought on and exacerbated by the necking down of the mold and the narrow cross-section of the strip which limits access to the surface of the metal bath. The further consequence of this is that the scum or slag on the widened surface of the metal bath at the top of the flared zone is difficult to remove and tends to be carried further downstream where it can foul the guides, or if it is entrapped within the casting, it can cause surface blisters on a casting when such materials penetrate into the surface of the casting and thereafter the casting is subjected to the water sprays between the idler rollers in the guides downstream of the mold. As a result, conventionally, substantial inconvenience and losses of metal occur at the time of concluding operations of a given melt.

Accordingly, it is an object of the invention to provide an operationally safe method and apparatus for the conclusion of the casting of a given melt in a continuous casting strip mill, which process and apparatus avoid the loss of stock through break-outs caused by the formation of plugs or resistance bridges above the neck of a flared-type mold and which also provide for the effective reduction of the scum on the surface of the metal bath in a continuous casting mold for strip, so as to avoid fouling the guides with same or causing the formation of blisters on the surface of the casting when applying sprayed water thereto.

BRIEF DESCRIPTION OF THE INVENTION

These and other objects of the invention are accomplished in an illustrative embodiment of the process in a strip casting mold having a flared pouring zone which necks down to a parallel sided distal zone, in which process the conclusion of casting is done by first reducing the pouring and withdrawal rates to respective values o $v_{Em}$ and $v_{Bm}$ at which rates the liquid core of the casting comes closer to the distal end of the mold at the same time ensuring that the distal end of the tip of the liquid core within the casting still extends just below the downstream, distal, end of the mold, thereby avoiding the risk of forming resistance bridges. These comparatively slow rates are carried on until pouring is terminated. The antioxidation and lubricating material which still remains on the surface, and the metal bath surface level now recede rapidly to the level of the neck in the mold. At this point the withdrawal rate of the casting is reduced to a rate of $v_{Br}$ which is selected to permit the receding upper surface of the metal bath to congeal and form a sufficiently solid covering to withstand further processing downstream, under optimum conditions of cooling and minimum oxidation and without concern about resistance bridges or solid plugs. Thereafter the withdrawal rate is again rapidly increased for the quick disposition of the trailing end of the strip.

It is a feature of the invention that the rapid reduction of the surface area of the metal bath from a maximum when the surface of the metal bath is at normal running level to a minimum when the surface of the metal bath reaches the neck of the mold, while still retaining within the cast strip a substantial width of the liquid core at the surface of the metal bath, effectively avoids the formation of congealed bridges or plugs above the neck, and thereby greatly minimizes the risk of break-out. In addition by rapidly reducing the surface area of the metal bath and placing the least mass in the zone of best cooling, and then slowing down the withdrawal rate only at that point, at which point the metal is cooling and building up a sufficiently thick congealed covering over its traialing end to withstand handling further downstream. This procedure thereby substantially minimizes the risk of cooling water being applied to liquid metal causing explosions with the disadantages of fouling the guides downstream or causing blisters on the surface of the casting.

A feature of both the process and the apparatus is that the steps are carried out and controlled automatically in response to metal bath level detectors, and liquid core sensors whose outputs are fed to a microprocessor with the result that the burden on the operational personnel is substantially reduced.

Further features are that the method and apparatus permit the casting of 50 mm thick strip at an extraction rate of $v_{bm}$ of 1.5 m/min. The level of the surface of the metal bath in the mold is determined by a multiplicity of temperature detectors embedded in the walls of the mold. The presence of the liquid core within the casting on the downstream side of the mold is determined by force sensors. The outputs of these detectors and sensors is fed to a microprocessor which generates and transmits control signals which control the operations of the associated pouring and withdrawal rate equipments in relation to preselected values.

BRIEF DESCRIPTION OF THE DRAWINGS

An embodiment of the invention selected for purposes of illustration is shown in the accompanying drawings in which.

DETAILED DESCRIPTION OF THE INVENTION

Figure 1:
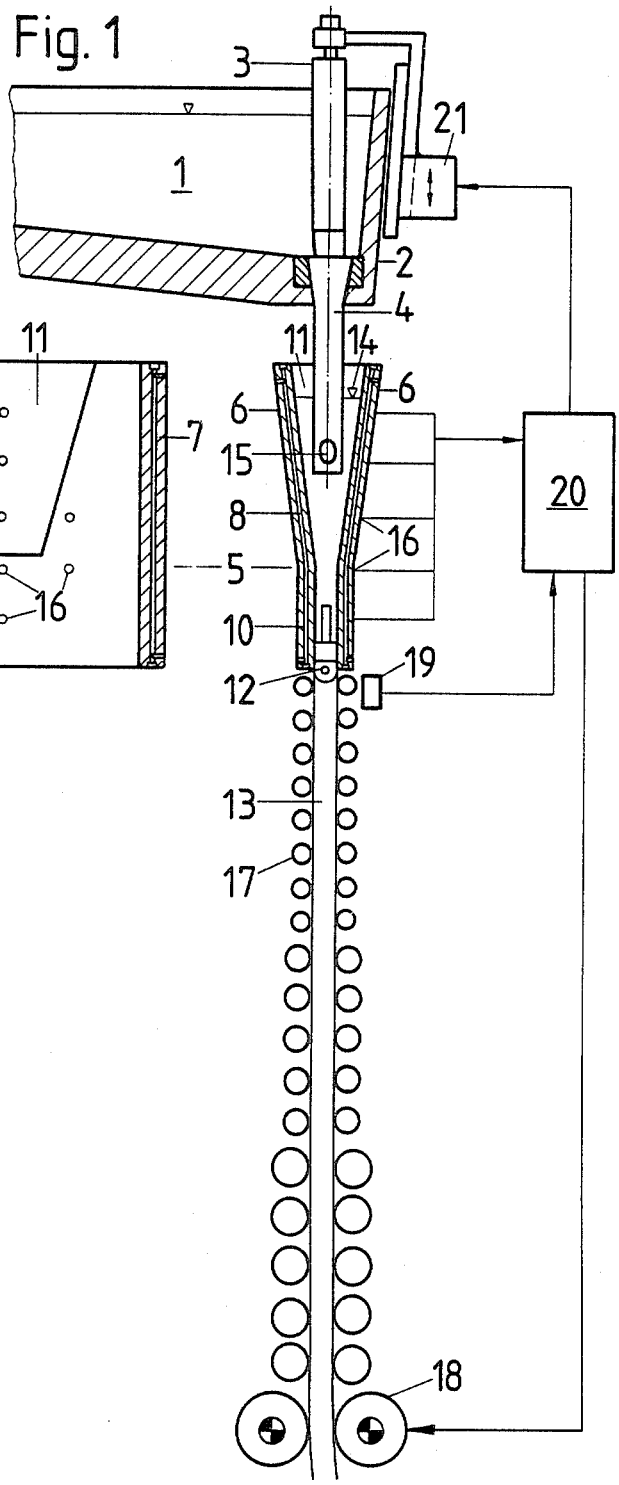
FIG. 1 is a diagramatical cross-sectional view of the continuous casting equipment of the invention showing a cross-section of the continuous casting strip mold in elevation from its narrow end.
Figure 2:
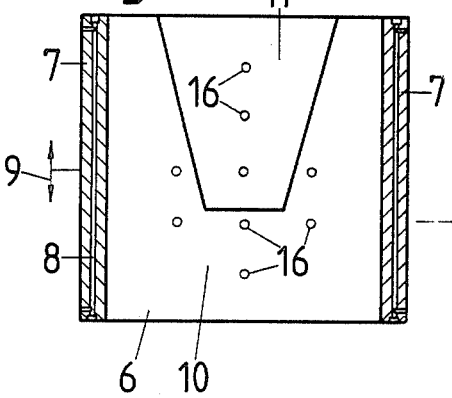
FIG. 2 is a sectional view of the continuous casting strip mold in side elevation.

The illustrative embodiment of the invention herein shown comprises a liquid steel melt 1 in a tundish 2 arranged to supply liquid steel to a pouring tube 4 at a pouring rate which is regulated by a valve 3 the vertical position of which (determined by servo mechanism 21) controls the size of the oriface leading from the tundish 2 into the pouring tube 4 and hence the pouring rate of the liquid steel. The pouring tube 4 supplies liquid steel to a strip shaped continuous casting strip mold indicated generally at 5 the cavity of which defines a narrow slot having broad side walls 6 and narrow end walls 7 each of which is provided with internal cooling ducts 8. A conventional oscillating mechanism (not shown) is provided to oscillate the mold vertically as indicated by arrows 9. The upper part of the mold is flared or tapered in a pouring zone 11 necking down to the desired size and shape of the strip to a zone 10 at the distal end of the mold where the side walls of the mold are parallel.

The liquid steel flows through the pouring tube 4, out through distribution ports 15 in the lower end of tube 4 into the mold and thence to a head 12 of a dummy strip 13. At start-up the surface level 14 of the metal bath rises as the mold cavity fills up, and once the level 14 covers the distribution ports 15, the liquid bath is then covered with a layer (not shown) of an anti-oxidation and lubrication material. The surface level 14 of the metal bath is determined by means of a multiplicity of temperature measuring detectors 16 embedded at various places in the broad side walls 6 of the mold both in the pouring zone 11 and in the lower parallel walled zone 10.

When pouring is started, a dummy strip 13 having a connection head 12 is positioned in a strip guide comprising an extendeed series of supporting rollers 17 downstream of the continuous casting strip mold, terminating with a pair of driven withdrawal rolls 18 which first withdraw the dummy strip and then the cast strip.

Figure 3A:
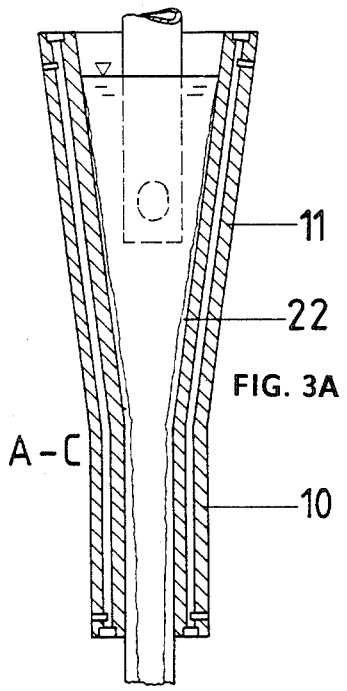
FIGS. 3A, 3B, 3C, and 3D are views in cross-section of the continuous casting strip mold in end elevation showing progressively four different stages of the conclusion of the casting operation for a given melt, and FIG. 4A contains a graph showing the time rate relationships betweem the pouring and the withdrawal rates for a process not utilizing the present method.
Figure 3B:
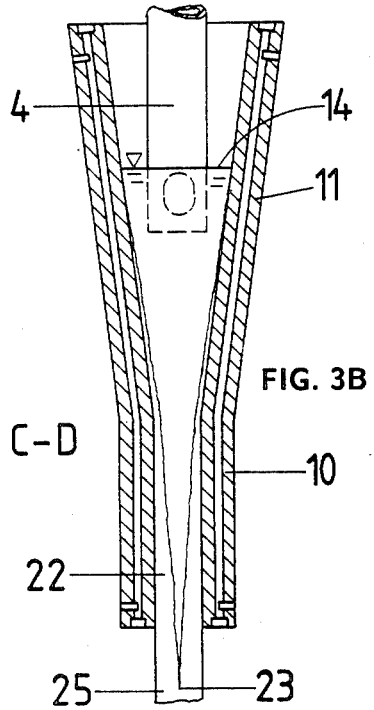
Figure 3C:
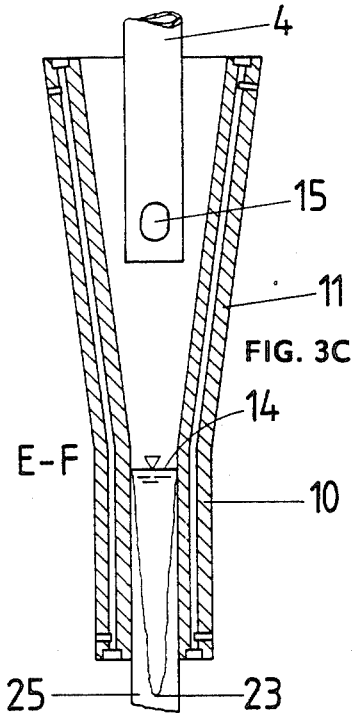
Figure 3D:
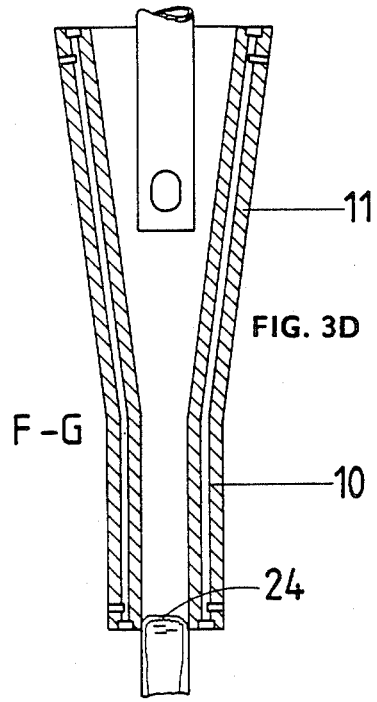
Figure 4A:
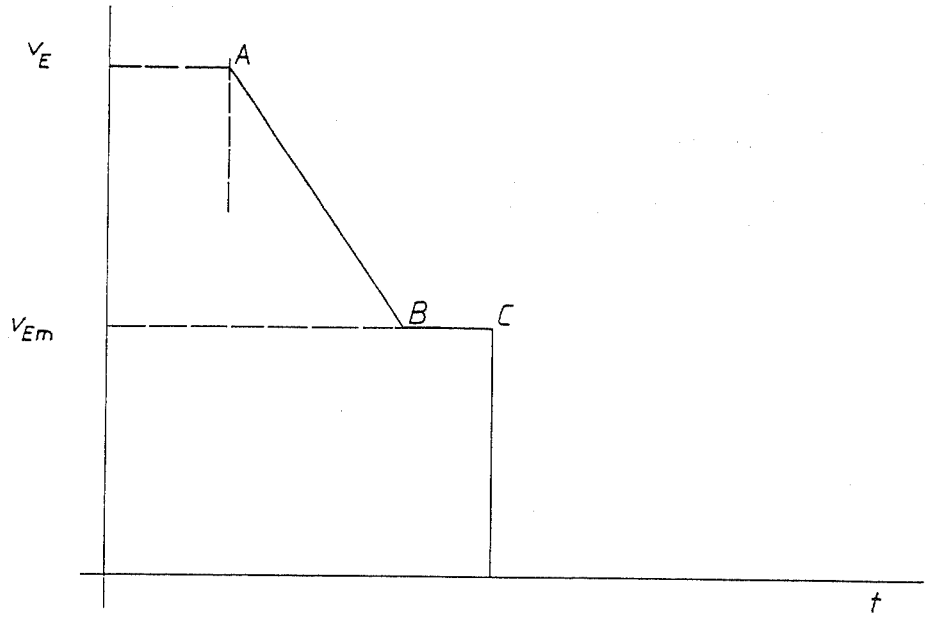
FIG. 4B is a graph showing the time rate relationships between the pouring and withdrawal rates for a process utilizing the present method.
Figure 4B:
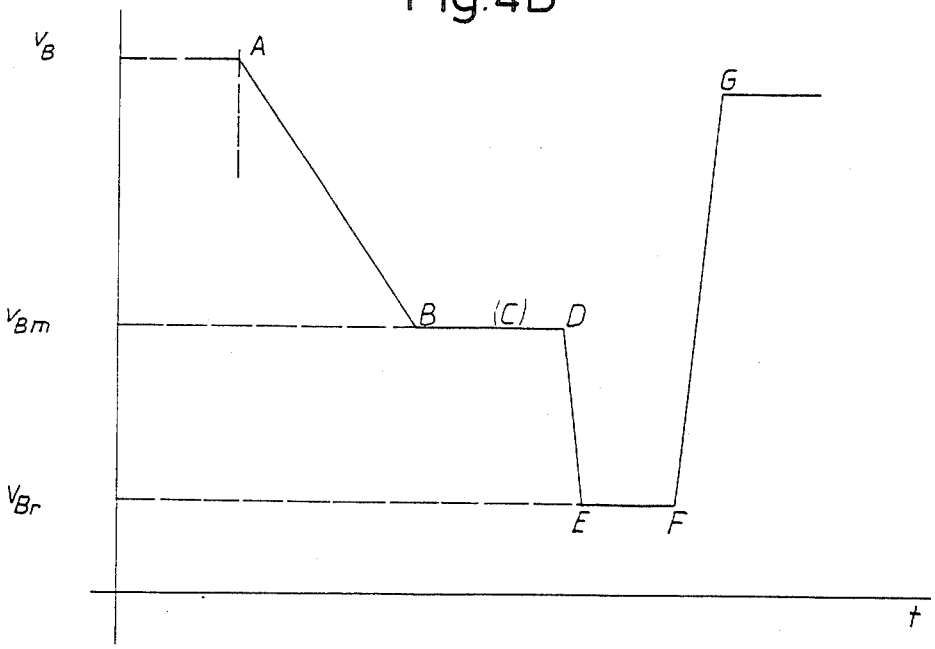

As the casting is withdrawn, it passes immediately on the downstream end of the mold under a pair of idler rollers in contact with the sides of the cast strip, which idler rollers are provided with force measuring sensors 19. If the tip of the liquid core within the congealed skin of the casting does not extend downstream of the mold 5 into the zone of the force measuring sensor 19, little or no force will be measured. However, when the cast strip is withdrawn at a sufficiently high rate to bring the tip end 23 of the liquid core of the cast strip below the point of the force measuring sensor 19, the fluid pressure within the core will cause the side walls of the casting to attempt to bulge slightly, and a force will be exerted against and detected by sensor 19. The output of the force measuring sensor is also fed to the microprocessor 20 which, in turn, controls the drive rate of the drive rollers 18 so as to provide a predetermined drive rate. In normal operation the surface level of the metal bath is maintained at a maximum height as shown in FIG. 3A. When this condition is reached, the pouring rate $v_E$, the surface level of the metal bath and the withdrawal rate $v_B$ all remain constant. (It is to be noted, however, that the upper and lower views of FIG. 4 are not precisely mutualy to scale in as much as $v_E$ and $v_B$ are to be taken as equal proportional according to the different cross sections of pouring and withdrawal). If the surface level then changes, both the pouring rate and the withdrawal rate are adjusted in response to the output of the detectors as compared to a predetermined norm to restore the surface of the metal bath to the desired level. On the other hand, if the withdrawal or pouring rates are changed disproportionately, the surface level will change, and the pouring and/or withdrawal rates must be adjusted accordingly to restore the level to the desired height.

With reference to FIG. 3, normal operation is shown in FIG. 3A with the metal bath level 14 at its maximum, with the skin 22 forming up the sides of the flared zone 11 and gradually increasing into the parallel, distal zone 10. In this condition, the liquid core within the cast strip extends a substantial distance downstream of the distal zone of the mold where its presence and the location of its tip end is sensed by sensors 19. When it is desireable to conclude the casting of a given melt, the pouring and withdrawing rates are both simultaneously reduced by proportional rates of reduction so that the metal bath level stays the same, to $v_{Em}$ and $v_{Bm}$. These rates approximate the minimum rates for maintaining the tip of the liquid core of the casting outside and downstream of the mold and to assure the avoidance of resistance bridges or solid plugs above the neck of the flared zone 11. At point C pouring is terminated (see FIG. 4A) and the surface of the metal bath drops down to the neck of the mold at which point the withdrawal rate is reduced to $v_{Br}$, which rate is selected to provide enough time in the distal zone for the exposed trailing surface of the casting to congeal sufficiently to withstand further processing downstream. Once this congealed covering has been formed, the withdrawal rate is again increased (see G in FIG. 4B) the casting is rapidly withdrawn, and the casting operation is concluded.

Having disclosed an illustrative embodiment, various modifications and adjustments of the invention, will now be apparent to those skilled in the art, without departing from the spirit of the invention. In addition, the sensing of the presence of the tip end of the liquid core of the casting near to but outside of the distal end of the mold can be done ultrasonically. Further, it is convenient to use two sensors for this purpose arranged one downstream of the other and to regulate the pouring and withdrawal rates so as to assure that the termination of pouring at step C is done when the tip of the liquid core lies between the two sensors. In this way the optimum point of termination can be attained without risk of resistance forming bridges. Other modifications will also be apparent, and accordingly it is not the intention to confine the invention to the precise form herein shown but rather to limit it only in terms of the appended claims.

We claim:

1. A method for concluding the operation of continuous casting of strip metal, comprising:

providing continuous casting mold having a flared inlet pouring zone necking down to a distal zone in which the walls of the mold are parallel and spaced apart by substantially the desired cross-sectional shape and dimensions of the strip being cast, pouring liquid metal through a pouring tube having an oriface into said flared zone, and controlling the pouring rate thereof, continuously detecting and monitoring the instantaneous surface level of the metal bath in said mold, withdrawing the casting from the distal end of said mold, and controlling the rate of withdrawal, adjusting the pouring rate and withdrawal rate so that the level of the metal bath is at a maximum height for said mold when in normal operation, continuously sensing whether or not there is present downstream of said mold evidence of the distal end of the liquid core of said cast strip, reducing the pouring and withdrawal rates for concluding the casting to a rate at which the distal end of the liquid core of the cast strip is near to but downstream of the mold and at which the metal bath level remains constant, thereafter terminating said pouring while continuing said withdrawal, whereby the metal bath level descends rapidly toward the neck end of said flared zone, reducing the withdrawal rate when the metal bath level is close to the lower end of the flared zone to a rate at which the upper surface of the metal bath can congeal sufficiently for further processing downstream by the time it reaches the end of the distal zone, and thereafter withdrawing the casting.

2. The process defined in claim 1 further characterized by:

generating signals corresponding to the metal bath surface level detection, and to the sensing of the presence of the distal end of the liquid core of the casting, processing the signals, and maintaining the pouring rate and withdrawal rate by comparing the actual pouring and withdrawal rates with preselected rates therefore.

3. The process defined in claim 1 further characterized by:

sensing the presence of said liquid core at a plurality of places spaced longitudinally of the casting, downstream of said mold.

4. The process defined in claim 1 further characterized by:

sensing the presence of said liquid core by means of force sensing.

5. The process defined in claim 1 further characterized by:

sensing the level of said metal bath by means of temperature detectors in the walls of said mold.

6. The process defined in claim 1 further characterized by:

forming a strip about 50 mm thick at a minimum withdrawal rate of 1.5 m/min.

* * * * *